United States Patent [19]

Brotherston

[11] Patent Number: 4,470,397

[45] Date of Patent: Sep. 11, 1984

[54] FUEL INJECTION PUMPING APPARATUS

[75] Inventor: Colin P. Brotherston, Rainham, England

[73] Assignee: Lucas Industries Public Limited Company, Birmingham, England

[21] Appl. No.: 437,478

[22] Filed: Oct. 28, 1982

[30] Foreign Application Priority Data

Nov. 11, 1981 [GB] United Kingdom ..... 8134043

[51] Int. Cl.[3] ..... F02M 59/20

[52] U.S. Cl. ..... 123/502; 123/501; 123/198 D

[58] Field of Search ..... 123/502, 501, 198 D, 123/357

[56] References Cited

U.S. PATENT DOCUMENTS

| | | | |
|---|---|---|---|
| 3,665,907 | 5/1972 | Laufer | 123/502 |
| 3,815,564 | 6/1974 | Suda et al. | 123/501 |
| 4,342,302 | 8/1982 | Straubel et al. | 123/502 |
| 4,359,994 | 11/1982 | Hofer et al. | 123/502 |
| 4,393,846 | 7/1983 | Mowbray et al. | 123/502 |

FOREIGN PATENT DOCUMENTS

| | | | |
|---|---|---|---|
| 56-146024 | 11/1981 | Japan | 123/502 |

*Primary Examiner*—Magdalen Y. C. Moy

[57] ABSTRACT

A fuel injection pumping apparatus has a high pressure pump to which fuel is supplied by a low pressure pump, the output pressure of which is controlled. The high pressure pump includes a piston which controls the timing of the high pressure pump. The pressure applied to the piston is controlled by valve means which includes a valve member biased by a spring. A solenoid is associated with an armature connected to the valve member and when the solenoid is energized the valve member is moved to increase the pressure applied to the piston. The valve member is also subjected to the fuel pressure developed by the low pressure pump and in the event that the flow of current in the solenoid ceases the valve member can move against the spring to allow a controlled pressure to be applied to the piston.

3 Claims, 4 Drawing Figures

FUEL INJECTION PUMPING APPARATUS

This invention relates to a fuel injection pumping apparatus of the kind comprising a high pressure pump which is arranged to deliver fuel at high pressure to an associated engine in timed relationship therewith, a low pressure pump for supplying fuel to the high pressure pump, valve means for controlling the output pressure of the low pressure pump so that it varies in accordance with the speed at which the apparatus is driven and a fuel pressure operable resiliently loaded piston for adjusting a component of the high pressure pump so that the timing of fuel delivery by the high pressure pump can be varied.

It is well known in the art to apply the output pressure of the low pressure pump to the piston so that the position of the piston varies in accordance with the speed of the associated engine. It is also known that this arrangement does not always provide the ideal timing variation and it is known to adapt the fluid system associated with the piston so that an account is taken of the amount of fuel being supplied by the apparatus. The modification of the fluid system in this manner is not easy, one of the problems being the limited variation of the output pressure of the low pressure pump with speed and a further problem being the need to restrict the amount of fuel which is lost in the fluid system and which is therefore not available for supply to the high pressure pump.

It has been proposed to control the pressure applied to the piston by using an electromagnetically operated value and to sense the position of the piston using a transducer. An example of such a system is shown in block form in British Published Specification No. 2017205. With any form of pumping apparatus incorporating electrical control, it is necessary to ensure that the apparatus either ceases to provide fuel in the event of an electrical failure or continues to supply fuel within acceptable limits.

It is an object of the present invention to provide such a system in a simple and convenient form and in which failure of the electrical circuits which control the flow of current to the valve will not result in malfunction of the associated engine.

According to the invention an apparatus of the kind specified comprises valve means interposed between the low pressure pump and a cylinder containing the piston, said valve means including a solenoid through which electric current can be passed to effect a control over the pressure applied to the piston and a resiliently loaded component which acts to effect a control over said pressure in the event of a cessation of current flow to the solenoid.

Figure 1:
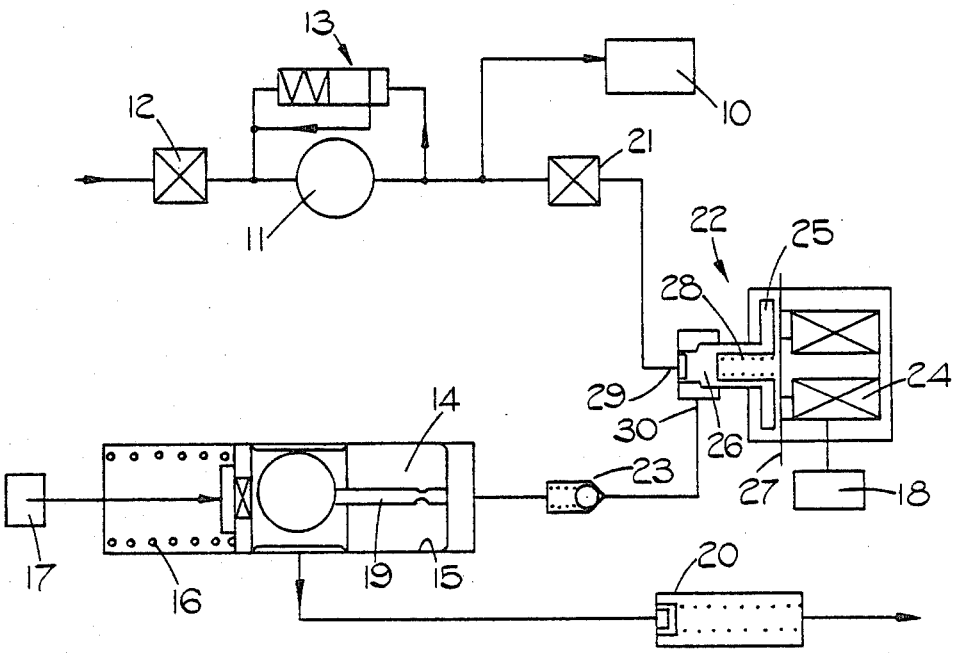
Figure 2:
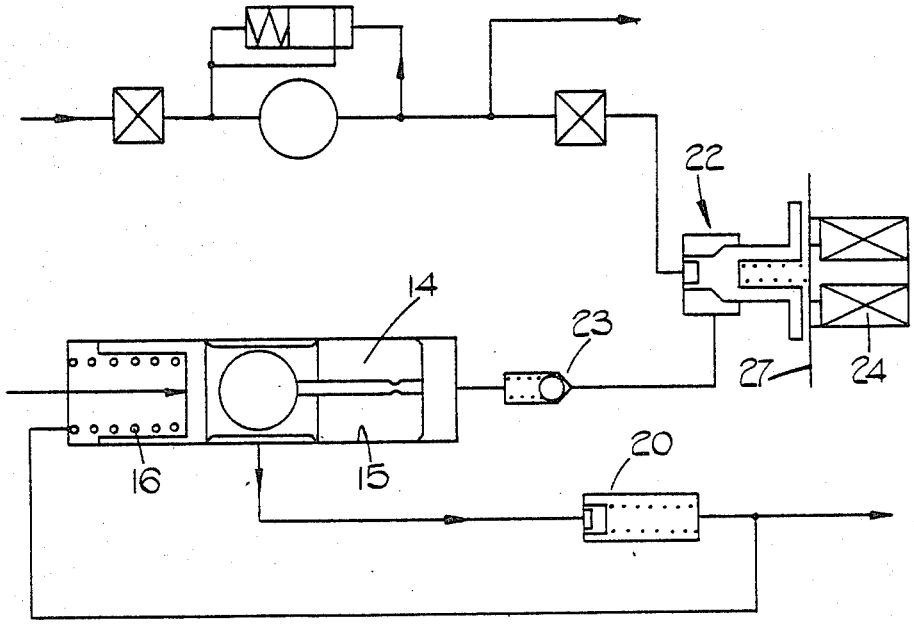
Figure 3:
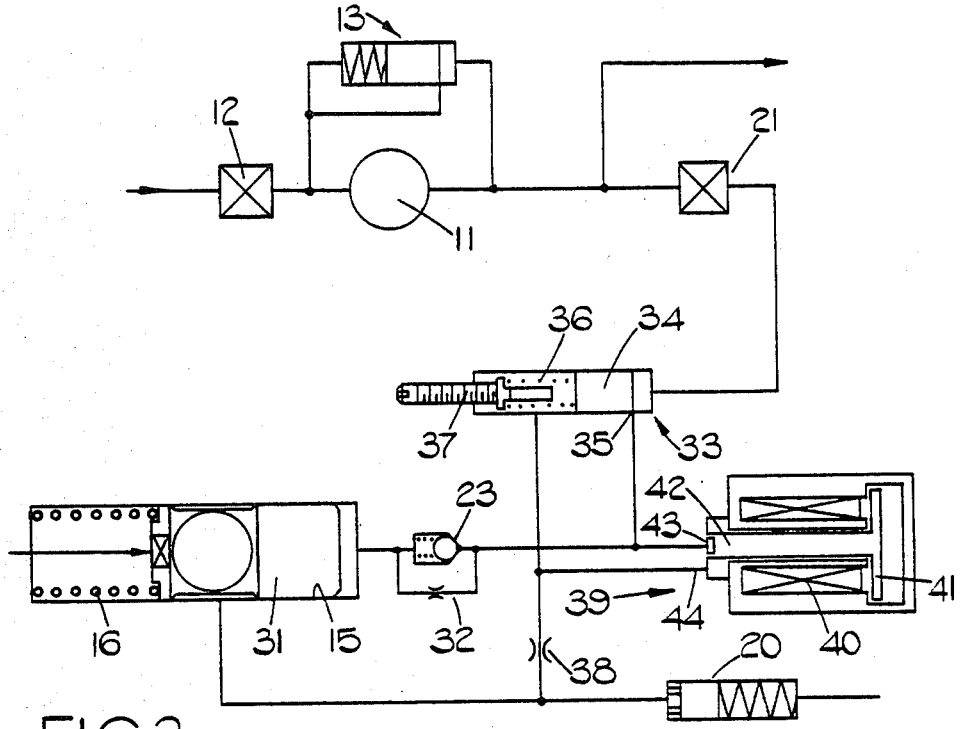
Figure 4:
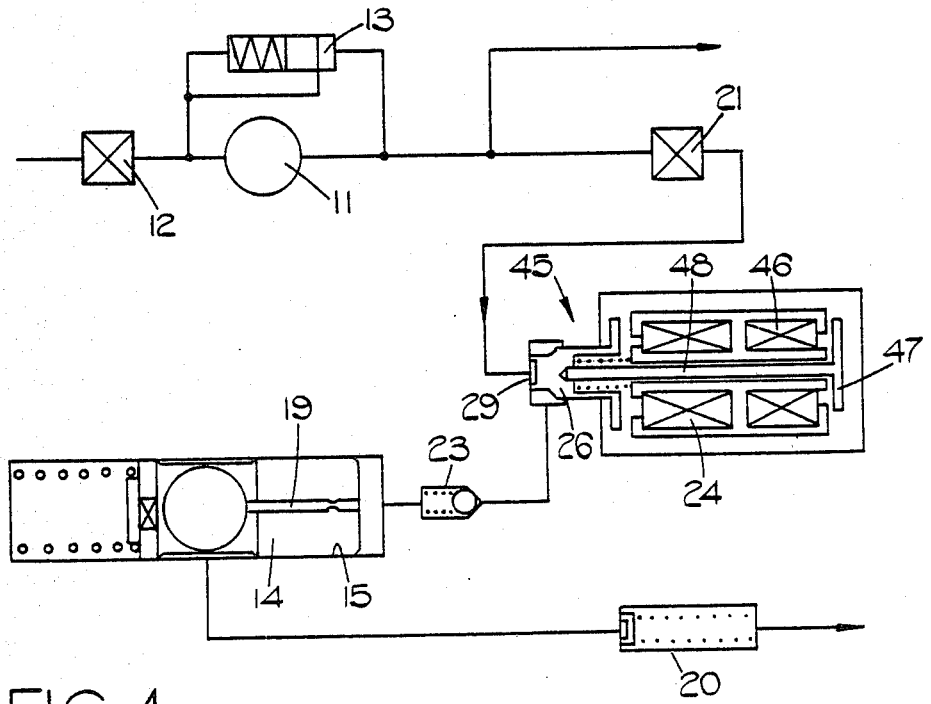

Examples of apparatus in accordance with the invention will now be described with reference to the accompanying drawings in which:

FIG. 1 is a diagrammatic representation of the fluid circuit associated with the piston, FIG. 2 is a view similar to FIG. 1 showing a modification, FIG. 3 is a view similar to FIG. 1 showing a further modification, and FIG. 4 is a view similar to FIG. 1 showing a further modification.

Referring to FIG. 1 of the drawings the apparatus comprises a high pressure injection pump 10 which may for example be of the rotary distributor type. Fuel is supplied to the pump 10 by means of a low pressure pump 11 which draws fuel through a filter 12. The output pressure of the low pressure pump is controlled by a valve 13 which includes a spring loaded piston whereby the outlet pressure varies in accordance with the speed at which the apparatus is driven.

The pump 10 incorporates a component for example a cam ring which is angularly adjustable to determine the timing of fuel delivery to the associated engine. The position of the cam ring is controlled by a piston 14 which is housed within a cylinder 15. The piston is loaded by a spring 16 in the direction to retard the timing of delivery of fuel to the associated engine. A transducer 17 is associated with the piston and this provides a signal to an electronic control system 18, indicative of the position of the piston and therefore the associated cam ring.

The piston 14 is provided with a restricted passage 19 which places the end of the cylinder remote from the spring, in communication with the interior of the housing of the apparatus. The pressure of fuel within the housing is controlled by a simple pressurising valve 20 which allows surplus fuel to be returned to the fuel tank.

The outlet of the low pressure pump is connected by way of a further filter 21 to a control valve generally indicated at 22. From the valve 22 fuel under pressure passes by way of a non-return valve 23 to the end of the cylinder remote from the spring and the arrangement is such that as the control valve alters the pressure applied to the piston, so the position of the piston varies to adjust the timing of fuel delivery. The valve 23 acts in a well known manner, to minimise movement of the piston under the action of cam reaction.

The control valve 22 includes a solenoid 24 which is supplied with electric current by the control system 18. Associated with the solenoid is an armature 25 which is connected to a valve member 26. Interposed between the armature and the solenoid is a diaphragm 27 which acts to prevent fuel reaching the solenoid. The valve member 26 has a pressure balancing groove and it is spring loaded by means of a spring 28, away from the solenoid 24 so that its recessed end covers a port 29 which is connected to the filter 21. An outlet port 30 communicates by way of the valve 23 with the cylinder 15.

The various parts of the valve 22 are shown in the position which they adopt when the engine is at rest. Considering now what happens when the engine is started and the outlet pressure of the pump 11 starts to rise. In the absence of electric current flow in the solenoid 24, the pressure acts upon the valve member 26 and at a predetermined pressure the valve lifts to place the ports 29 and 30 in communication with each other. The pressure at the port 30 is applied to the piston 14 which moves against the action of the spring 16 to adjust the timing of fuel delivery. The pressure drop which occurs across the valve 22 due to fuel flow through the passage 19, is predetermined by the force exerted by the spring 28 and as the output pressure of the low pressure pump 11 increases so also will the pressure applied to the piston 14. In the absence of electric current flow in the solenoid the pressure applied to the piston 14 will be controlled.

As mentioned above there is a predetermined pressure drop across the valve 22 in the absence of electric current flow in the solenoid. If electric current is allowed to flow in the solenoid under the action of the control system 18, a magnetic force is applied to the armature 25 to oppose the action of the spring 28. Thus the pressure drop across the valve will decrease by an amount depending upon the electric current flow. The pressure applied to the piston 14 will therefore increase. The control system 18 receives a signal from the transducer 17 indicative of the position of the piston and hence the current flow in the solenoid can be modified to provide the required setting of the piston.

FIG. 2 shows a modification in which the pressure applied at the back of the piston 14 is drain pressure rather than the pressure existing in the housing of the apparatus. This is achieved by connecting the end of the cylinder containing the spring 16 to downstream of the valve 20. This modification means that there is increased pressure available for operating the piston 14.

Turning now to the example shown in FIG. 3, parts which have the same function as the parts shown in FIGS. 1 and 2, are provided with the same reference numerals. In this case the piston now referenced 31, does not incorporate the passage 19. The duty of this passage in allowing restricted flow of fuel from the cylinder 15 when the pressure supplied by way of the valve reduces, is provided by an orifice 32 connected in parallel with the valve 23. The portion of the cylinder containing the spring 16 is in communication with the housing of the apparatus as with the example of FIG. 1.

The valve means which controls the pressure applied to the piston has a different form and it is divided into two valves the first being referenced 33, comprises a valve member 34 slidable within a cylinder one end of which is connected to the filter 21. The valve member controls a port 35 in the wall of the cylinder, the port being connected by way of the valve 23 to the end of the cylinder 15 remote from the spring 16. The valve member 34 is biased by a spring 36 and the force which can be exerted by this spring is adjustable by means of an adjustable abutment 37. The portion of the cylinder in which the valve member 34 is mounted and which contains the spring 36 communicates with the upstream side of the valve 20 by way of an orifice 38.

The other valve is referenced 39 and includes a solenoid 40 which is supplied with electric current by the control system. The valve includes an armature 41 which is an integral part of a valve member 42 which has a similar construction to the valve member 26 of the valve shown in FIG. 1. In this case however the valve member is not spring loaded. The recessed end portion of the valve member 42 co-operates with a port 43 which is connected to the port 35 and the outlet 44 of the valve 39 is connected to upstream of the orifice 38.

In operation, and assuming for the moment that no current is flowing in the solenoid 40 the pressure which is applied to the piston 31 is determined by the valve 33 and as the outlet pressure of the pump 11 increases, so also will the pressure applied to the piston 31. Because of the pressure at the port 43 of the valve 39 the valve member 42 will be moved to a fully open position and therefore it will be seen that the orifice 38 also plays a part in determining the pressure applied to the piston 31. If electric current is passed through the winding 40 the flow through the orifice 38 will be decreased and hence the pressure applied to the piston 31 will increase. Thus with this example if the flow of current in the winding 40 fails a pressure will continue to be applied to the piston 31 to permit functioning of the associated engine.

The arrangements so far described allow fuel under pressure to be applied to the piston in the event of failure of the control circuit or the solenoid winding. FIG. 4 shows a modification of the example shown in FIG. 1, in which the control valve now referenced 45 is provided with an additional solenoid 46 which can be energised to provide a force acting on the valve member 26 assisting the action of the spring. The solenoid 46 has an armature 47 associated with it and this is directly connected to the valve member 26 by means of a push rod 48. When the solenoid 46 is energised therefore the armature 47 exerts a force upon the valve member 26 in a direction to assist the action of the spring. If the solenoid is fully energised the port 29 is fully closed thereby allowing the piston 14 to move to the fully retarded position.

I claim:

1. A fuel injection pumping apparatus comprising a high pressure pump arranged to deliver fuel at high pressure to an associated engine in timed relationship therewith, a low pressure pump for supplying fuel to the high pressure pump, first valve means for controlling the output pressure of the low pressure pump so that it varies in accordance with the speed at which the apparatus is driven, a fuel pressure operable resiliently loaded piston for adjusting a component of the high pressure pump so that the timing of fuel delivery by the high pressure pump can be varied, second valve means interposed between the low pressure pump and a cylinder containing the piston, a restricted flow path from downstream of said second valve means, said second valve means including a solenoid through which electric current can be passed to effect a control over the pressure applied to the piston, a spring loaded valve member which acts to effect a control over said pressure in the event of a cessation of current flow to the solenoid, said valve member defining a surface against which fuel under pressure from the outlet of the low pressure pump can act to oppose the action of said spring, movement of said valve member against the action of said spring allowing an increased flow of fuel through the second valve means, and an armature associated with said solenoid, said armature being connected to said valve member, whereby when said solenoid is energized, a force will be applied to the valve member in opposition to the force exerted by the spring.

2. An apparatus according to claim 1 including a further valve member having an armature connected thereto, said armature being responsive to the magnetic field produced by said solenoid, said further valve member with increasing current flow in said solenoid acting to reduce the flow of fuel through the second valve means and thereby acting to increase the pressure applied to said piston.

3. An apparatus according to claim 1, including a further solenoid and a further armature, said further armature being coupled to said valve member whereby when said further solenoid is energised the valve member will be held in a position to prevent application of fluid pressure to said piston.

* * * * *